US011248358B2

(12) United States Patent
Zhang et al.

(10) Patent No.: US 11,248,358 B2
(45) Date of Patent: Feb. 15, 2022

(54) GEOGRID AND MANUFACTURING METHOD THEREOF

(71) Applicants: Man Zhang, Gansu (CN); LANZHOU DEKE ENGINEERING MATERIALS CO., LTD, Gansu (CN)

(72) Inventors: Man Zhang, Gansu (CN); Yongkong Wei, Gansu (CN)

(73) Assignees: Man Zhang; LANZHOU DEKE ENGINEERING MATERIALS CO., LTD.

( * ) Notice: Subject to any disclaimer, the term of this patent is extended or adjusted under 35 U.S.C. 154(b) by 88 days.

(21) Appl. No.: 16/626,638

(22) PCT Filed: Jun. 13, 2018

(86) PCT No.: PCT/CN2018/091051
§ 371 (c)(1),
(2) Date: Dec. 26, 2019

(87) PCT Pub. No.: WO2019/001277
PCT Pub. Date: Jan. 3, 2019

(65) Prior Publication Data

US 2020/0224382 A1 Jul. 16, 2020

(30) Foreign Application Priority Data

Jun. 27, 2017 (CN) ..... 201710500214.9
Jun. 27, 2017 (CN) ..... 201720785316.5
(Continued)

(51) Int. Cl.
*E02D 17/20* (2006.01)
*E01C 3/04* (2006.01)
*E02D 3/00* (2006.01)

(52) U.S. Cl.
CPC .... *E02D 17/202* (2013.01); *E02D 2300/0084* (2013.01)

(58) Field of Classification Search
CPC ..... E02D 17/202; E02D 2300/0084
See application file for complete search history.

(56) References Cited

U.S. PATENT DOCUMENTS 4,572,705 A * 2/1986 Vignon ..... E02D 17/18 405/16
5,927,906 A 7/1999 Bach et al.
(Continued)

FOREIGN PATENT DOCUMENTS

CN 102677647 A * 9/2012
CN 103669143 A 3/2014
(Continued)

OTHER PUBLICATIONS

International Search Report from PCT Application No. PCT/CN2018/091051 dated Sep. 13, 2018, pp. 1-16, including English translation.

*Primary Examiner* — Benjamin F Fiorello
*Assistant Examiner* — Stacy N Lawson
(74) *Attorney, Agent, or Firm* — The Belles Group, P.C.

(57) ABSTRACT

A geogrid and a manufacturing method thereof. The geogrid comprises multiple ribs, and the multiple ribs are connected to each other at multiple junctions to form multiple cells. At each junction, two or more adjacent ribs of the multiple ribs are inserted into each other via inserts, and each junction is covered by a plastic material. The geogrid can easily be extended to a present state at a construction site, prevent tearing of apertures, prevent soil from leaking from the apertures, and prevent the inserts from rusting or corroding. Since the plastic material, the ribs, and the inserts are bonded to each other, separation strength at the junction is markedly increased. Preferably, an end portion of the insert is completely covered by the plastic material to form an end cap,
(Continued)

and the plastic material and the ribs and the inserts are bonded to each other to form columns.

16 Claims, 8 Drawing Sheets

(30) Foreign Application Priority Data

Jun. 11, 2018 (CN) ..... 201810596847.9
Jun. 11, 2018 (CN) ..... 201820901315.7

(56) References Cited

U.S. PATENT DOCUMENTS

| | | | | | |
|---|---|---|---|---|---|
| 6,484,473 | B1 * | 11/2002 | Hall | E01C 3/006 405/17 | |
| 8,092,122 | B2 * | 1/2012 | Senf | E02D 17/202 405/302.4 | |
| 8,459,903 | B2 * | 6/2013 | Senf | E02D 17/20 405/302.4 | |
| 8,827,597 | B2 * | 9/2014 | Bach | A44B 11/04 405/302.4 | |
| 2016/0230353 | A1 | 8/2016 | Halahmi et al. | | |

FOREIGN PATENT DOCUMENTS

| | | | | | |
|---|---|---|---|---|---|
| CN | 104404942 | A | | 3/2015 | |
| CN | 104452730 | A | * | 3/2015 | |
| CN | 104594324 | A | * | 5/2015 | |
| CN | 104594324 | A | | 5/2015 | |
| CN | 105064316 | A | * | 11/2015 | D04H 1/64 |
| CN | 105064316 | A | | 11/2015 | |
| CN | 205444152 | U | | 8/2016 | |
| CN | 205857152 | U | * | 1/2017 | |
| CN | 205857152 | U | | 1/2017 | |
| CN | 107869098 | A | | 4/2018 | |
| CN | 207259892 | U | | 4/2018 | |
| DE | 29622342 | U1 | * | 5/1998 | D04H 1/64 |
| JP | S6018150 | U | | 2/1985 | |
| JP | H0667535 | U | | 9/1994 | |
| JP | 2000219731 | A | | 8/2000 | |
| JP | 2004338743 | A | | 12/2004 | |
| JP | 2005025145 | A | | 1/2005 | |
| JP | 2005028681 | A | | 2/2005 | |
| JP | 2006125050 | A | | 5/2006 | |
| JP | 3128107 | U | | 12/2006 | |
| JP | 2008024397 | A | | 2/2008 | |
| JP | 2011256666 | A | | 12/2011 | |
| JP | 2012504058 | A | | 2/2012 | |
| JP | 2015017375 | A | | 1/2015 | |
| JP | 2015161123 | A | | 9/2015 | |
| JP | 2016532798 | A | | 10/2016 | |
| KR | 20150137764 | A | | 12/2015 | |
| RU | 2323301 | | | 4/2008 | |
| RU | 2478753 | | | 4/2013 | |
| RU | 2581176 | | | 4/2016 | |
| WO | WO2010036270 | A1 | | 4/2010 | |

* cited by examiner

GEOGRID AND MANUFACTURING METHOD THEREOF

CROSS-REFERENCE TO RELATED PATENT APPLICATIONS

The present application is the national phase of International Application No. PCT/CN2018/091051, titled "GEOGRID MANUFACTURING METHOD THEREOF," filed on Jun. 13, 2018, which claims the benefit of priorities to the following four Chinese patent applications, the disclosures of which are incorporated herein by reference:

1) Chinese patent No. 201710500214.9, filed with the China National Intellectual Property Administration on Jun. 27, 2017, titled "GEOCELL AND MANUFACTURING METHOD THEREOF";

2) Chinese patent No. 201720785316.5, filed with the China National Intellectual Property Administration on Jun. 27, 2017, titled "GEOCELL";

3) Chinese patent No. 201810596847.9, filed with the China National Intellectual Property Administration on Jun. 11, 2018, titled "GEOCELL AND MANUFACTURING METHOD THEREOF"; and 4) Chinese patent No. 201820901315.7, filed with the China National Intellectual Property Administration on Jun. 11, 2018, titled "GEOCELL."

FIELD

The present application relates to a geocell and a manufacturing method thereof.

BACKGROUND

The contents in this section only provide background information relating to the present application, which may not necessarily constitute the prior art.

The geocell has been widely used in the field of geotechnique such as subgrade construction and slope greening. The geocell is a honeycomb-shaped or grid-shaped three-dimensional structure formed by connecting multiple strips in different ways. At present, the geocell in the market is mainly formed by welding, riveting or interconnecting the strips.

For the geocell formed by welding or riveting joints, an existing problem is that the tensile strength of the strip is significantly inconsistent with the tensile strength of the joint, that is, the tensile strength of the joint is significantly lower than the tensile strength of the rib.

In order to solve the problem that the tensile strength of the strip is inconsistent with that of the joint, a technical solution of forming the geocell by interconnecting the strips through U-shaped steel nails is proposed. In the technical solution, multiple slits are formed on two strips adjacent to each other. The slits extend in a longitudinal direction of the strips, are parallel to each other, and are spaced apart from each other in a height direction of the strips. Two upright portions of the U-shaped steel nail sequentially and alternately pass through the slits of the strips, thereby interconnecting the two strips together to form the geocell. In the geocell formed by interconnecting the strips through the U-shaped steel nails, the tensile strength of the strip is substantially the same as that of the joint.

However, such a geocell formed by interconnecting still has the following problems. First, on the one hand, the slits are easy to tear, especially easy to transversely tear, due to the existence of the slits in the strips; on the other hand, after the U-shaped steel nails are inserted into the slits, the slits are tensioned and opened to a certain extent, so the soil may leak through the slits, reducing the binding force of each cell of the geocell to the soil. In addition, at present, the laying of the geocell at the construction site is carried by manual tensioning. An angle between adjacent strips of each cell varies due to different magnitude and different directions of the artificial tension, so that the individual cells of the geocell have different shapes and tightness, and the whole geocell may still be in a relaxed state after being tensioned. It is difficult to tension each cell to a preset state, thereby affecting the application effect of the geocell.

In addition, due to the specific application environment of the geocell, the U-shaped steel nails are usually exposed to moist soil, and are prone to rust and corrosion, thus affecting the connection strength of the joints. At present, the U-shaped steel nails are usually galvanized to improve corrosion resistance. However, the galvanizing process may heavily pollute the surrounding environment, and generally fails to meet the environment requirements and is boycotted. In addition, if the U-shaped steel nails are not completely galvanized during the galvanizing process or there is a bareness portion due to the peeling of the coating, rust may occur and the anticorrosion function may fail.

SUMMARY

An object of the present application is to solve one or more of the above problems.

One aspect of the present application is to provide a geocell, the geocell includes multiple strips, and the multiple strips are connected with each other at multiple joints to form multiple cells. At each joint, two or more adjacent strips of the multiple strips are interconnected with each other via an insert, and each joint is covered by a colloid.

At each joint, two or more adjacent strips of the multiple strips are aligned, and are provided with slits penetrating the two or more adjacent strips. The slits extend along a longitudinal direction of the two or more adjacent strips, and the insert sequentially and alternately passes through the slits to interconnect the two or more adjacent strips together.

In an embodiment, the slits are distributed at equal intervals along a height direction of the two or more adjacent strips.

In an embodiment, the colloid covers each side surface of the two or more adjacent strips to completely cover the slits, and covers at least part of the insert.

The slits are completely covered by the colloid, which, on the one hand, can prevent the slits from being torn, and on the other hand, can avoid the leakage of the soil through the slits, thereby improving the binding force of each cell of the geocell to the soil.

Preferably, the insert at each joint is completely covered by the colloid. At each joint, the insert is bonded with the two or more adjacent strips and the colloid to form a whole, and end portions of the insert are completely covered by the colloid to form end covers. The end cover may be in any of the following shapes: hemisphere, cuboid, and cone. On the one hand, the insert is prevented from being rusted and corroded, and the end portions of the insert are better protected and are prevented from being corroded by the soil. On the other hand, the colloid is bonded with the strips and the insert to form a whole, which significantly improves the peel strength at the joint and enhances the structural stability of the joint. In addition, the overall structure of the geocell is more elegant when the geocell is laid at the construction site.

In an embodiment, the colloid covers the joint by injection molding.

Each joint is in a presetting state, so that two or more adjacent strips are at a predetermined angle to each other, which enables the geocell to be easily stretched to a predetermined state at the construction site.

The colloid is molded at the joint with an injection temperature lower than a melting temperature of the rib.

In an embodiment, the strips are made of a PP material or a PET material.

In an embodiment, the strips are made of the PP material or the PET material by drawing.

The colloid is made of one or more of the following materials: TPE, TPR, TPU, SBS, EVA, silica gel, PVC, PP, PE, HDPE, TPEE, EBA, EEA, and EMA.

A section of the cell in the height direction of the strip is in any of the following shapes: triangle, square, rectangle or rhombus.

In an embodiment, the insert is a U-shaped member, and two upright portions of the U-shaped member sequentially and alternately pass through the slits.

In an embodiment, a connecting sheet for the U-shaped member is provided at the end portions of the two upright portions of the U-shaped member.

In an embodiment, a thickness of the colloid covered on each side surface of the two or more adjacent strips is greater than or equal to that of the corresponding strip of the two or more adjacent strips.

Another aspect of the present application is to provide another geocell, the geocell includes multiple strips, and the multiple strips are connected with each other at multiple joints to form multiple cells. At each joint, two or more adjacent strips of the multiple strips are interconnected with each other via an insert, each joint is covered by a colloid, and the insert is completely covered by the colloid.

At each joint, two or more adjacent strips of the multiple strips are aligned, and are provided with slits penetrating the two or more adjacent strips. The slits extend along a longitudinal direction of the two or more adjacent strips, and the insert sequentially and alternately passes through the slits to interconnect the two or more adjacent strips together.

In an embodiment, the slits are distributed at equal intervals along a height direction of the two or more adjacent strips.

The colloid covers each side surface of the two or more adjacent strips to completely cover the slits.

In an embodiment, at each joint, the insert is bonded with the two or more adjacent strips and the colloid to form a whole, and end portions of the insert are completely covered by the colloid to form end covers.

The end cover may be in any of the following shapes: hemisphere, cuboid, and cone.

In an embodiment, the colloid covers the joint and the insert by injection molding.

In an embodiment, each joint is in a presetting state, so that two or more adjacent strips are at a predetermined angle to each other.

The colloid is molded at the joint with an injection temperature lower than a melting temperature of the rib.

In an embodiment, the strips are made of a PP material or a PET material.

In an embodiment, the strips are made of the PP material or the PET material by drawing.

The colloid is made of one or more of the following materials: TPE, TPR, TPU, SBS, EVA, silica gel, PVC, PP, PE, HDPE, TPEE, EBA, EEA, and EMA.

A section of the cell in the height direction of the strip is in any of the following shapes: triangle, square, rectangle or rhombus.

In an embodiment, the insert is a U-shaped member, and two upright portions of the U-shaped member sequentially and alternately pass through the slits.

In an embodiment, a connecting sheet for the U-shaped member is provided at the end portions of the two upright portions of the U-shaped member.

A thickness of the colloid covered on each side surface of the two or more adjacent strips is greater than or equal to that of the corresponding strip of the two or more adjacent strips.

Another aspect of the present application is to provide a method for manufacturing the geocell. The method includes the following steps: arranging multiple strips; aligning two or more adjacent strips of the multiple strips at joints and forming slits penetrating the two or more adjacent strips; at the joint, sequentially and alternately passing an insert through the slits to interconnect the two or more adjacent strips together; and encapsulating the joint to form a colloid.

In an embodiment, the slits are distributed at equal intervals along a height direction of the two or more adjacent strips.

In an embodiment, the colloid covers each side surface of the two or more adjacent strips to completely cover the slits, and covers at least part of the insert.

The slits are completely covered by the colloid, which, on the one hand, can prevent the slits from being torn, and on the other hand, can avoid the leakage of the soil through the slits, thereby improving the binding force of each cell of the geocell to the soil.

Preferably, the insert at each joint is completely covered by the colloid. At each joint, the insert is bonded with the two or more adjacent strips and the colloid to form a whole, and end portions of the insert are completely covered by the colloid to form end covers. The end cover may be in any of the following shapes: hemisphere, cuboid, and cone. On the one hand, the insert is prevented from being rusted and corroded, and the end portions of the insert are better protected and are prevented from being corroded by the soil. On the other hand, the colloid is bonded with the strips and the insert to form a whole, which significantly improves the peel strength at the joint and enhances the structural stability of the joint. In addition, the overall structure of the geocell is more elegant when the geocell is laid at the construction site.

In an embodiment, the step of encapsulating is achieved by injection molding.

The two or more adjacent strips bear a predetermined tension before performing the step of encapsulating or during the step of encapsulating.

Before performing the step of encapsulating or during the step of encapsulating, the two or more adjacent strips are stretched by a predetermined angle relative to each other, which enables the geocell to be easily stretched to a predetermined state at the construction site.

In an embodiment, the colloid goes through vulcanization after the step of encapsulating or during the step of encapsulating.

The colloid is molded at the joint with an injection temperature lower than a melting temperature of the rib.

In an embodiment, the strips are made of a PP material or a PET material.

In an embodiment, the strips are made of the PP material or the PET material by drawing.

The colloid is made of one or more of the following materials: TPE, TPR, TPU, SBS, EVA, silica gel, PVC, PP, PE, HDPE, TPEE, EBA, EEA, and EMA.

The multiple strips are connected with each other at multiple joints to form multiple cells. A section of the cell in the height direction of the strip is in any of the following shapes: triangle, square, rectangle or rhombus.

In an embodiment, the insert is a U-shaped member, and two upright portions of the U-shaped member sequentially and alternately pass through the slits.

In an embodiment, a connecting sheet for the U-shaped member is provided at the end portions of the two upright portions of the U-shaped member.

In an embodiment, a thickness of the colloid covered on each side surface of the two or more adjacent strips is greater than or equal to that of the corresponding strip of the two or more adjacent strips.

Another aspect of the present application is to provide a method for manufacturing the geocell. The method includes the following steps: arranging multiple strips; aligning two or more adjacent strips of the multiple strips at joints and forming slits penetrating the two or more adjacent strips; at the joint, sequentially and alternately passing an insert through the slits to interconnect the two or more adjacent strips together, and encapsulating the joint to form a colloid, wherein the colloid completely covers the insert.

Another aspect of the present application is to provide a geocell manufactured by the method for manufacturing the geocell according to the present application.

Providing the colloid at each joint of the geocell can bring beneficial technical effects. On the one hand, the colloid arranged at each joint causes the adjacent strips at each joint to be at the predetermined angle relative to each other, so that the geocell can be easily stretched to the predetermined state at the construction site of the geocell. On the other hand, the colloid arranged at each joint covers the slits and the insert at each joint, which can prevent the slits from being torn, can avoid the leakage of the soil through the slits, and can prevent the insert from rust and corrosion due to the influence of the moist soil. In addition, it is preferred that the end portions of the insert are completely covered by the colloid to form the end covers. The colloid is bonded with the strips and the insert to form a column, which significantly improves the peel strength at the joint, enhances the structural stability of the joint, and makes the overall structure more elegant.

BRIEF DESCRIPTION OF THE DRAWINGS

The embodiments of the present application are described hereinafter only in an exemplary manner with reference to the drawings. In the drawings, same features or components are denoted by same reference numerals and the drawings are not necessarily drawn to scale.

DETAILED DESCRIPTION OF THE EMBODIMENTS

Figure 1:
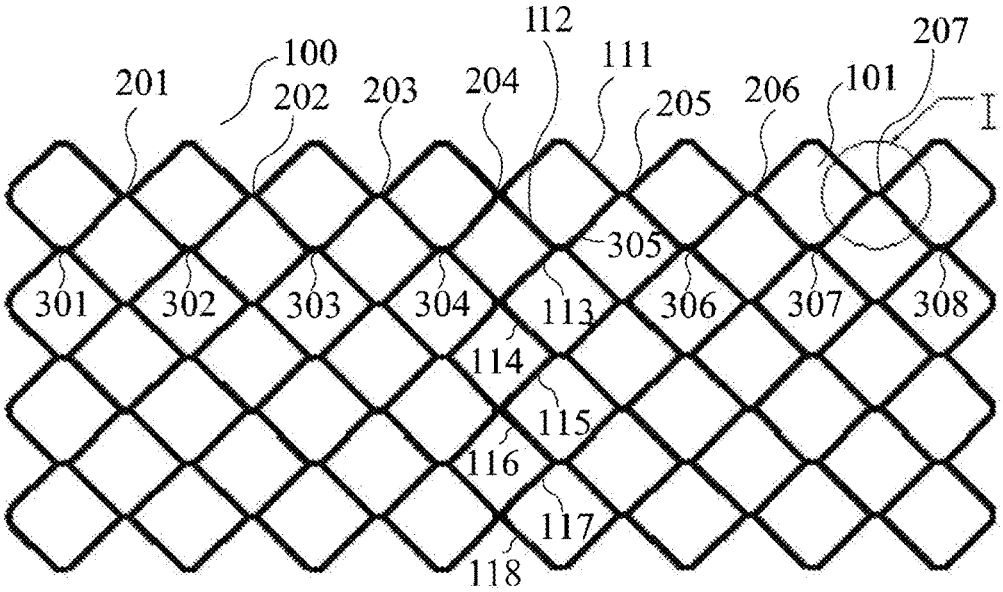
FIG. 1 is a top view of a geocell according to an embodiment of the present application.

The description below is merely illustrative in nature and is not intended to limit the present application, the application and the use. It should be understood that, in all these drawings, similar reference numerals refer to the same or similar parts and features. Various drawings only schematically represent the conception and principle of various embodiments of the present application, and do not necessarily show the specific size and scale of various embodiments of the present application. Related details or structures of the various embodiments of the present application may be illustrated in an exaggerated manner for a particular drawing or for a specific portion of the drawing.

Figure 2:
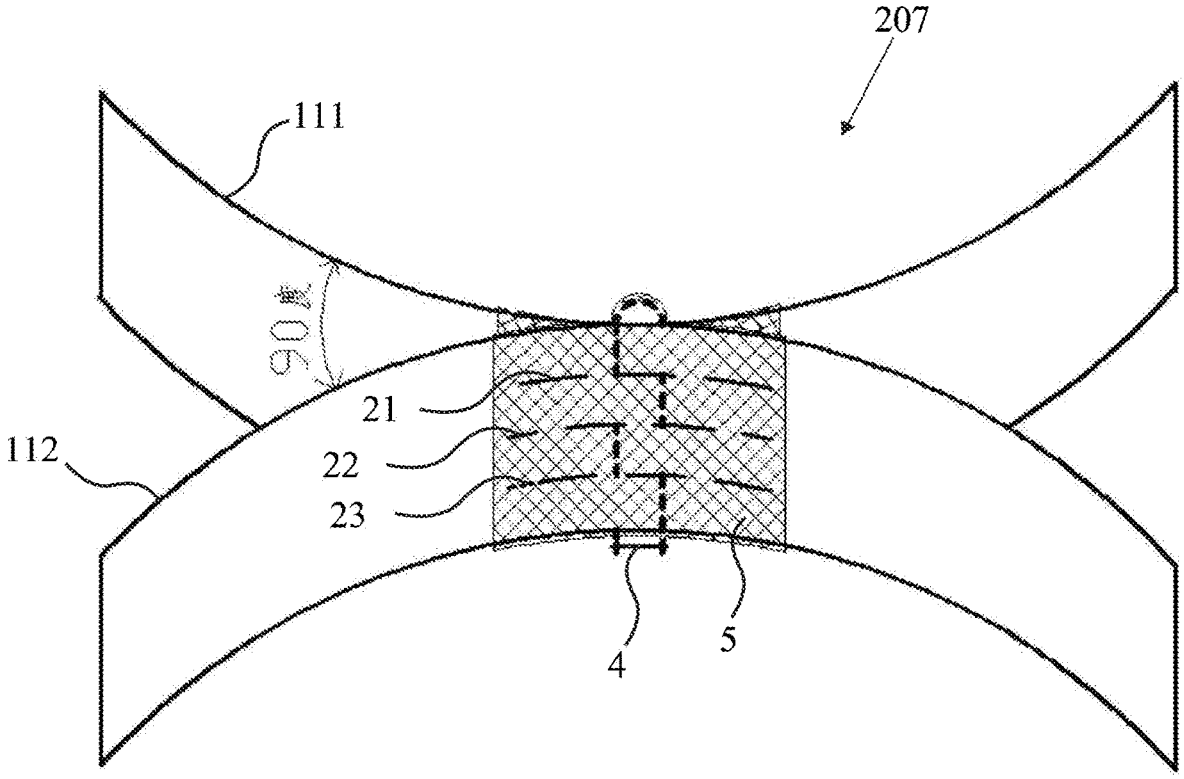
FIG. 2 is an enlarged perspective view of a joint in a circle I of FIG. 1.
Figure 3:
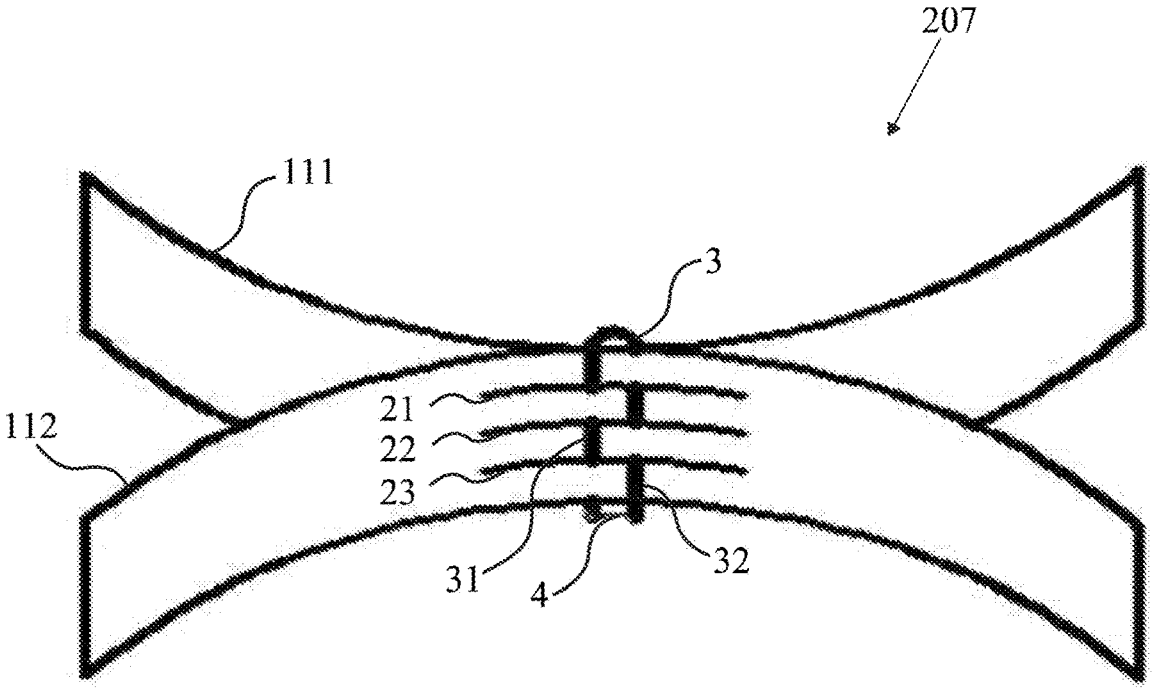
FIG. 3 is an enlarged perspective view of the joint in the circle I of FIG. 1 before being encapsulated.

FIGS. 1 to 3 show a geocell 100 according to a first embodiment of the present application. The geocell 100 includes multiple strips, that is, a first strip 111, a second strip 112, a third strip 113, a fourth strip 114, a fifth strip 115, a sixth strip 116, a seventh strip 117 and an eighth strip 118. Two or more adjacent strips of the multiple strips are connected with each other at various joints to form a meshed structure having multiple cells 101. For example, two adjacent strips of the multiple strips, first strip 111 and second strip 112, are connected to each other at the joints 201, 202, 203, 204, 205, 206 and 207, respectively. Other two adjacent strips of the multiple strips, second strip 112 and third strip 113, are connected to each other at the joints 301, 302, 303, 304, 305, 306, 307 and 308, respectively. Other strips are connected in a similar manner and will not be described herein again. It should be understood by those skilled in the art that, the number of the strips, the number of the joints of the adjacent strips, and the spacing of the adjacent strips are not limited thereto, but may vary according to the specific application.

The strip is preferably made of a PP material (polypropylene) by drawing, but the manufacturing material and the manufacturing method are not limited thereto. The strip may also be made of a PET material (polyethylene terephthalate) or other high molecular polymer sheets. In addition to drawing, the strip may also be formed by molding.

At each joint of the geocell, two strips are interconnected to each other via a U-shaped member. Specifically, the U-shaped member alternately passes through the slits formed on the strips, so that the strips and two upright portions of the U-shaped member at the slits form a woven configuration with each other in a lateral direction and a vertical direction. In order to prevent the U-shaped member from falling off the rib, a connecting sheet 4 for the U-shaped member may be provided at end portions of the two upright portions of the U-shaped member. The U-shaped member is a steel member. Alternatively, the U-shaped member may also be made of other materials as long as the material can meet the tensile strength at the joint.

Since the configuration of each joint of the geocell 100 is substantially the same, a detailed configuration of a joint 207 in the geocell 100 will be described in detail below with reference to FIG. 2 to FIG. 3.

FIG. 2 is an enlarged perspective view of the joint 207. As shown in FIG. 2, a colloid 5 covers each side surface of the first strip 111 and the second strip 112 at the joint 207 between the adjacent first strip 111 and second strip 112.

FIG. 3 is an enlarged perspective view of the joint before encapsulation. As shown in FIG. 3, multiple slits such as three slits are formed at the joint 207 between the adjacent first strip 111 and the second strip 112, which extend along a longitudinal direction of the first strip 111 and the second strip 112 and penetrate the first strip 111 and the second strip 112, that is, a first slit 21, a second slit 22 and a third slit 23. The three slits are parallel to each other and are distributed at equal intervals along a height direction of the first strip 111 and the second strip 112. The two upright portions of the U-shaped member 3 sequentially and alternately pass through the three slits. Specifically, as shown in FIG. 3, a first upright portion 31 of the U-shaped member 3 passes through the first slit 21 from a side where the second strip 112 is located, and a second upright portion 32 of the U-shaped member 3 passes through the first slit 21 from a side where the first strip 111 is located. Then, the first upright portion 31 of the U-shaped member 3 passes through the second slit 22 from the side where the first strip 111 is located, and the second upright portion 32 of the U-shaped member 3 passes through the second slit 22 from the side where the second strip 112 is located. The first upright portion 31 and the second upright portion 32 of the U-shaped member sequentially pass through other slits in a similar manner. Thereby, portions of the first strip 111 and the second strip 112 located above the first slit 21 are located behind the first upright portion 31 of the U-shaped member 3 and located in front of the second upright portion 32; portions of the first strip 111 and the second strip 112 located between the first slit 21 and the second slit 22 are located in front of the first upright portion 31 of the U-shaped member 3 and located behind the second upright portion 32; portions of the first strip 11 and the second strip 112 located between the second slit 22 and the third slit 23 are located behind the first upright portion 31 of the U-shaped member 3 and located in front of the second upright portion 32; and portions of the first strip 111 and the second strip 112 located below the third slit are located in front of the first upright portion 31 of the U-shaped member 3 and located behind the second upright portion 32.

At a interconnection joint as shown in FIG. 3, the colloid 5 is further formed around the joint to form a joint structure as shown in FIG. 2. The colloid 5 is formed on each side surface of the strip at the interconnection joint by injection molding and covers the slits and the U-shaped member. The colloid 5 is made of a soft TPE (thermoplastic elastomer) material, but is not limited thereto. The colloid 5 may also be made of other soft materials such as TPR (thermoplastic rubber), TPU (thermoplastic polyurethane), SBS (styrene), EVA (ethylene-vinyl acetate copolymer), silica gel, PVC (polyvinyl chloride), TPEE (thermoplastic polyester elastomer), EBA (ethylene-butyl acrylate copolymer), EEA (ethylene-ethyl acrylate), and EMA (ethylene-methyl acrylate copolymer), so that the strips after the encapsulation can have better flexibility and are easy to fold and transport. In addition, the colloid 5 may also be made of a series of plastic polymer materials such as PP (polypropylene), PE (polyethylene), and HDPE (high-density polyethylene), so that the hardness and strength of the strips after the encapsulation are better. Compared with the colloid made of a soft material, the flexibility of the strip encapsulated by the colloid made of the plastic polymer materials is slightly inferior. If the strip is made of the PP material, the colloid 5 may be made of the soft material, for example, the TPE material, which makes the colloid 5 more compatible with the rib. If the strip is made of the PET material, for example, the colloid 5 may be made of the TPEE material, which makes the colloid 5 more compatible with the rib. The material of the colloid 5 can be selected in consideration of the compatibility of the strip with the colloid and the flexibility and strength requirements of the strip after encapsulation.

Referring to FIG. 2, at the joint as shown in the figure, a length of the colloid 5 is greater than the length of each slit in a longitudinal direction of the first strip 111 and the second strip 112, so that the colloid 5 completely covers the first slit 21, the second slit 22 and the third slit 23 penetrating the first strip 111 and the second strip 112 on each side (that is, at a corner portion of each cell) and at least partially covers the U-shaped member. A thickness of the colloid on each side surface of the first strip 111 and second strip 112 may be greater than or equal to the thickness of each rib. In the exemplary embodiment as shown in FIG. 1 to FIG. 3, the thicknesses of the first strip 111 and second strip 112 is between 0.8 mm and 1 mm, and the thickness of the colloid formed on each side surface of the first strip 111 and second strip 112 is about 1 mm. It should be noted that, the above dimensions are merely illustrative, and the thickness of the strips and the thickness of the colloid can be selected according to specific application requirements and transportation conditions.

Figure 4:
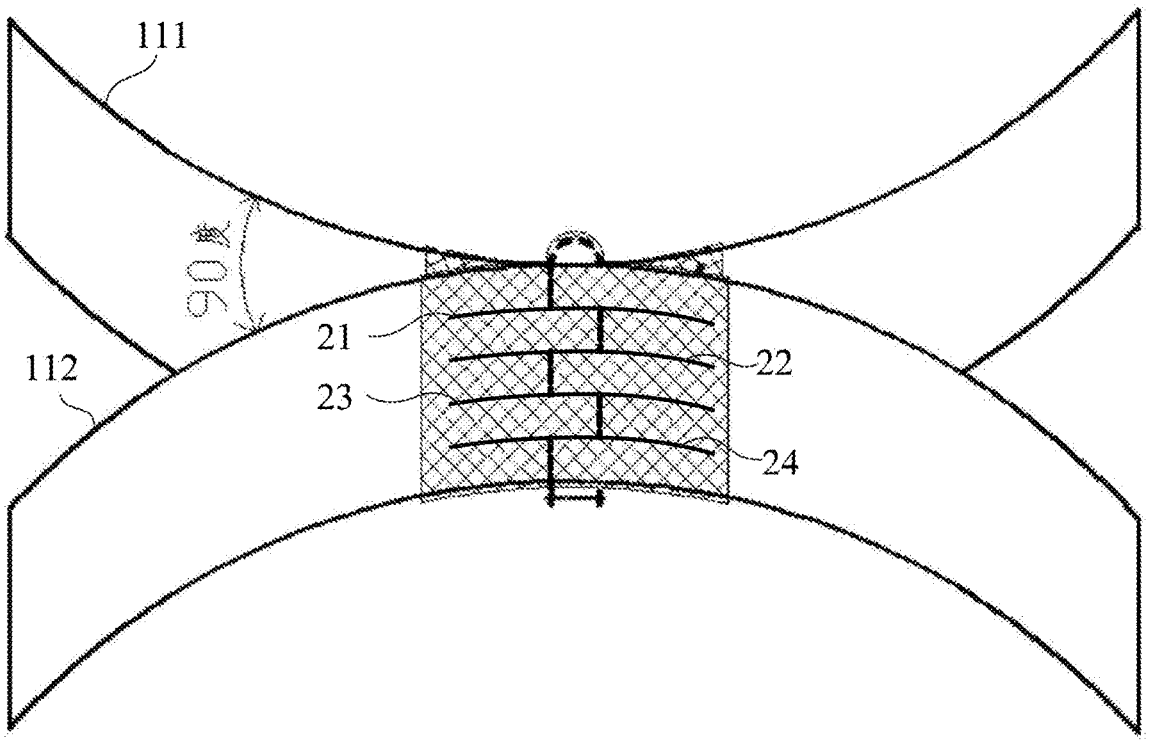
FIG. 4 is an enlarged perspective view of the joint of the geocell according to another embodiment of the present application.
Figure 5:
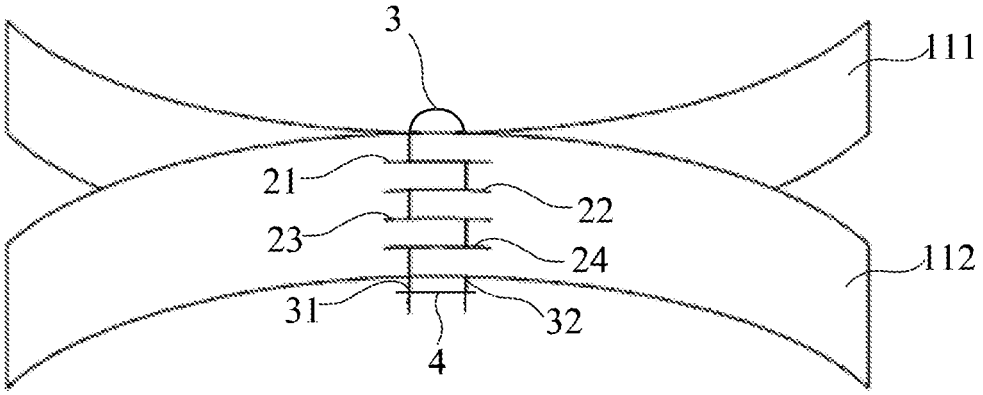
FIG. 5 is an enlarged perspective view of the joint shown in FIG. 4 before being encapsulated.

In the above embodiment, at the shown joint, three slits are provided on the rib. However, it should be understood by those skilled in the art that, the number of the slits is not limited thereto and can be increased or decreased as needed; and there is no special requirement for the length of the slit as long as it is easy to interconnect the U-shaped member. FIG. 4 and FIG. 5 show enlarged views of the joint of the geocell according to another embodiment of the present application. FIG. 4 shows an enlarged perspective view of the joint, and FIG. 5 shows a perspective view of the joint before the encapsulation. The structure of the joint shown in FIG. 4 and FIG. 5 is substantially the same as the structure of the joint shown in FIG. 2 and FIG. 3, and the difference is the number of the slits provided on the strips. At the joint shown in FIG. 4 and FIG. 5, four slits extending along the longitudinal direction of the first strip 111 and the second strip 112 and cutting through the first strip 111 and the second strip 112 are provided, that is, the first slit 21, the second slit 22, the third slit 23 and the fourth slit 24. Similar to the above, the first upright portion 31 and the second upright portion 32 of the U-shaped member sequentially pass through the four slits.

In the two embodiments shown above, at each joint, the presence of the colloid 5 causes the two strips of each cell to be in a presetting state in which an included angle between the two strips is about 90 degrees. It should be understood by those skilled in the art that, each cell can be presetting into other forms, such as squares, rectangles, and rhombuses, such that the geocell can be easily restored at the construction site of the geocell to the presetting state in which each cell is substantially square or rectangular or rhombus shaped, so as to achieve an optimal soil conservation effect, although the geocell is compressed or folded into a transportable form during the transport of the geocell.

By providing the colloid 5 around each joint, the colloid 5 completely covers the slits and at least partially covers the U-shaped member, which on the one hand can prevent the slits from being torn and enhance the strength at the joint, and on the other hand can avoid the leakage of the soil through the slits and prevent the U-shaped member 3 from rust and corrosion due to the influence of the moist soil.

Figure 6:
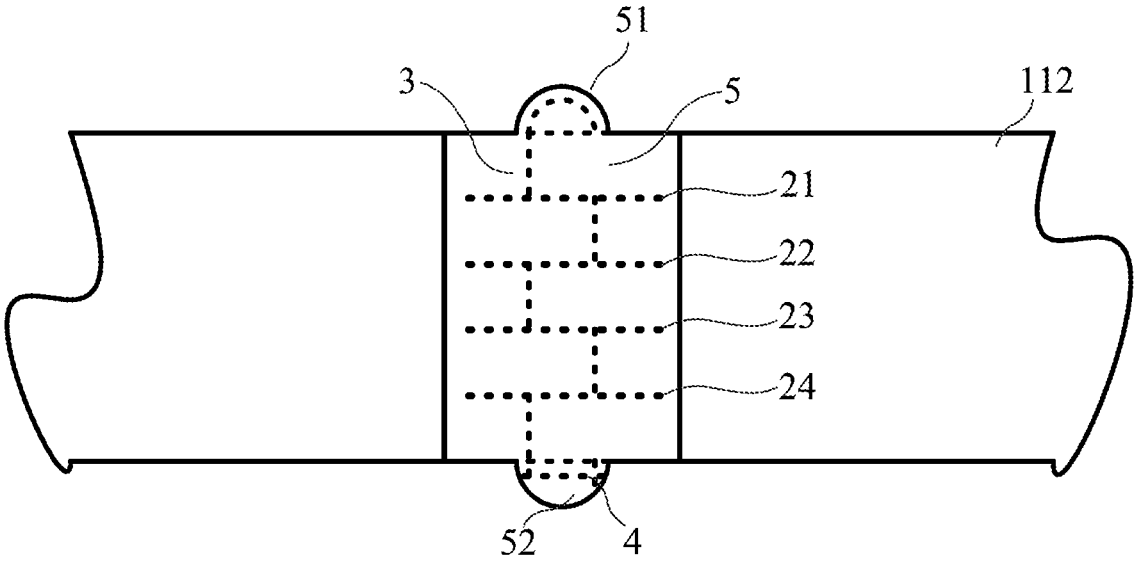
FIG. 6 is an enlarged front view of the joint according to a preferred embodiment of the present application.
Figure 7:
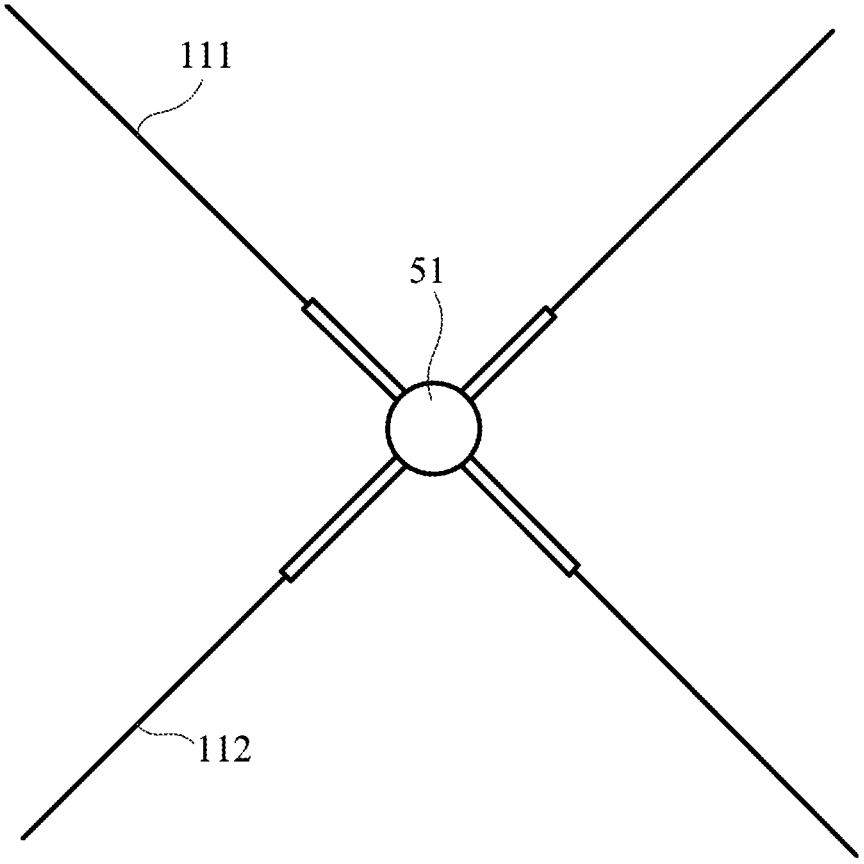
FIG. 7 is a top view of the joint shown in FIG. 6.

Preferably, the colloid 5 further completely covers the U-shaped member. FIG. 6 shows an enlarged front view of the joint of the preferred embodiment, and FIG. 7 shows a top view of the joint of the preferred embodiment. The structure of the joint shown in FIG. 6 and FIG. 7 is identical to the structure of the joint before the encapsulation shown in FIG. 4 and FIG. 5 (as shown in FIG. 5), and the only difference is that the U-shaped member 3 of the preferred embodiment is completely covered by the colloid after the encapsulation.

As shown in FIG. 6 and FIG. 7, the U-shaped member 3 inserted between the slits is completely covered by the colloid 5. End portions of the U-shaped member 3 are covered by the colloid 5 to form end covers 51 and 52, respectively. In the present embodiment, the end covers 51, 52 are hemispherical. It should be understood by those skilled in the art that, the end covers 51, 52 are not limited to the hemispherical, but may also have other suitable shapes such as cuboid and cone. A portion of the U-shaped member 3 located between the first strip Ill and the second strip 112 is covered by the colloid, so that the colloid is bonded with the strips and the portion of the U-shaped member 3 to form a whole. In the shown embodiment, the colloid, the strips and the portion of the U-shaped member 3 form a column having a substantially rectangular section. However, the section of the column formed by the colloid, the strips and the portion of the U-shaped member 3 may also be in other shapes according to the amount of the injected colloid and the situation of the pre-tensioning of the strips during the injection of the colloid. For example, the section of the column may also be approximately square, circular or the like. A thickness of the colloid at the end portion of the U-shaped member 3 is greater than the thickness of the colloid at the portion of the U-shaped member 3 located between the first strip 111 and the second strip 112 (that is, the colloid on the side surfaces of the first strip 111 and the second strip 112). When the geocell thus formed is laid at the construction site, the column formed by the colloid 5 covering the U-shaped member 3 can enhance the structural stability of the joint, improve the anticorrosion performance and also make the overall structure more elegant.

Figure 8:
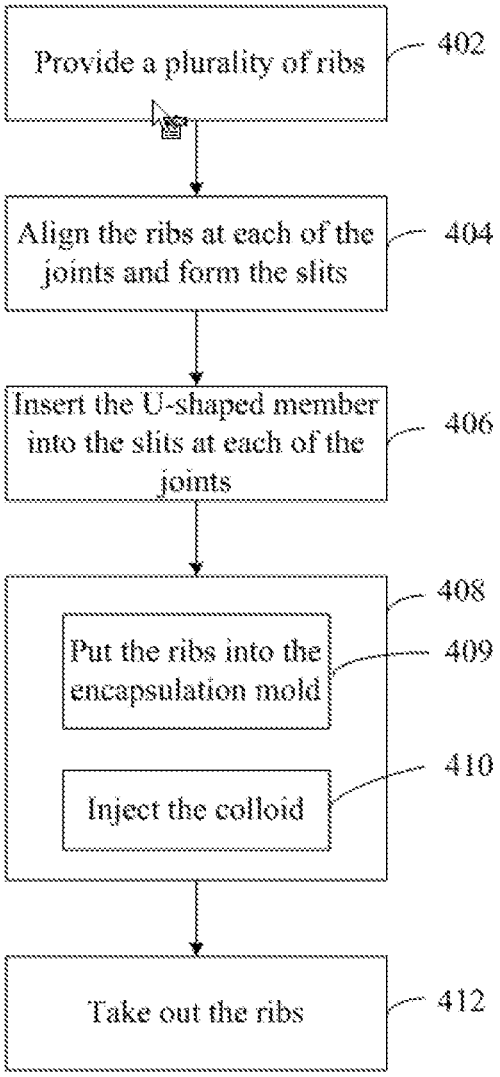
FIG. 8 is a flow chart of a method for manufacturing the geocell according an embodiment of the present application.

FIG. 8 shows a flow chart of a method for manufacturing the geocell according to an embodiment of the present application. The method is described hereinafter with the geocell having the joint shown in FIG. 6 and FIG. 7 as an example.

First, in Step 402, multiple strips are provided and arranged. Then, in Step 404, at each joint, two or more adjacent strips of the multiple strips are aligned and provided with slits penetrating the strips. In the exemplary embodiment of the geocell having the joint shown in FIG. 6 to FIG. 7, the adjacent two strips are aligned at each joint, and four slits are formed at equal intervals along the height direction of the rib. For example, at each of the joints 201, 202, 203, 204, 205, 206 and 207, the first strip 11*l* is aligned with the second strip 112, and the first slit 21, the second slit 22, the third slit 23 and the fourth slit 24 are formed at equal intervals along the height direction of the rib. Similarly, at each of the joints 301, 302, 303, 304, 305, 306, 307 and 308, the second strip 112 is aligned with the third strip 113, and four slits are formed at equal intervals along the height direction of the rib.

Here, it should be noted that, the number of the slits, the length of the slits, and the interval between the slits as shown above are merely exemplary and should not be construed as a limitation. The number of the slits, the length of the slits and the interval between the slits can be configured according to the height of the strip and the size of each cell. For example, the height of the strip may be 50 mm, 75 mm, 100 mm, 150 mm, 200 mm, 250 mm, or 300 mm, but is not limited thereto. The above dimensions are merely exemplary, and the dimensions of the strip of the geocell can be selected according to specific application requirements and transportation conditions, and the number of the slits, the length of the slits and the interval between the slits are accordingly set.

Figure 12:
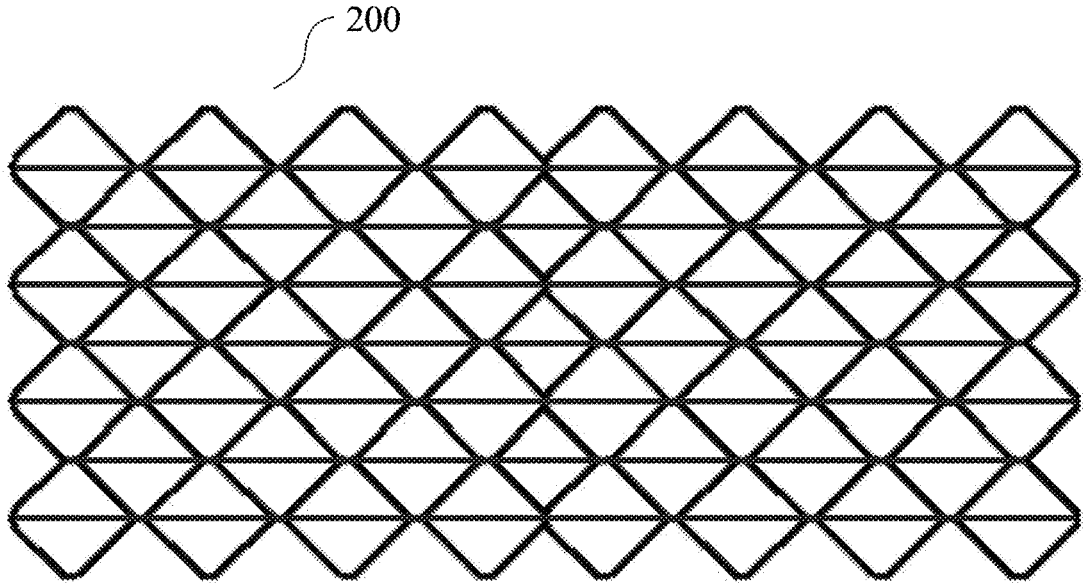
FIG. 12 to FIG. 13 illustrate the geocell according to other embodiments of the present application.
Figure 13:
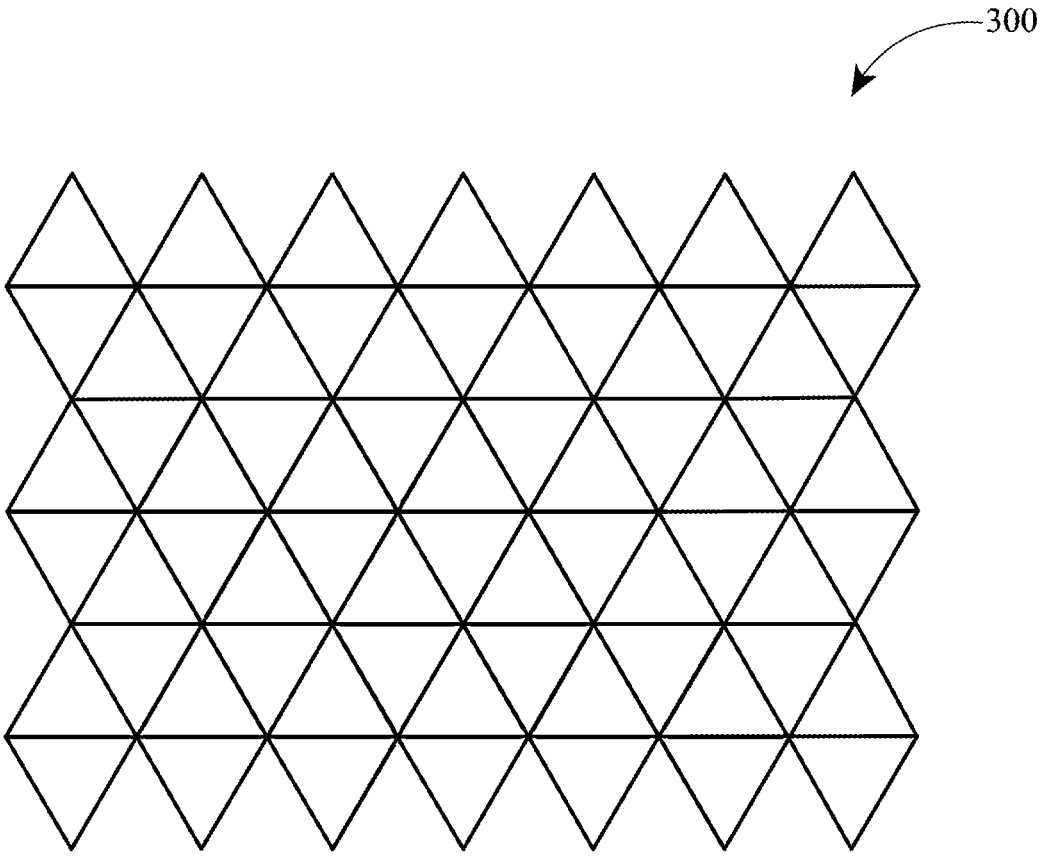

In addition, as shown above, at each joint, the adjacent two strips are aligned and are provided with the slits, but the present application is not limited thereto. At each joint, the desired number of the strips can be aligned and can be provided with slits according to the shape of each cell of the geocell. For example, at each joint, three adjacent strips may be aligned and be provided with slits to form the geocell as shown in FIG. 12 and FIG. 13.

In Step 406, at each joint, the two upright portions of the U-shaped member 3 are sequentially and alternately inserted into each slit. After the two upright portions of the U-shaped member pass through the last slit (in the exemplary embodiment shown in FIG. 6 and FIG. 7, the last slit is the fourth slit 24), the connecting sheet 4 for the U-shaped member is attached to the end portions of the first upright portion 31 and the second upright portion 32 of the U-shaped member, to prevent the U-shaped member from falling off the rib. However, it should be understood by those skilled in the art that, the connecting sheet 4 for the U-shaped member is not indispensable, and the connecting sheet for the U-shaped member may be saved according to the specific application.

Figure 9:
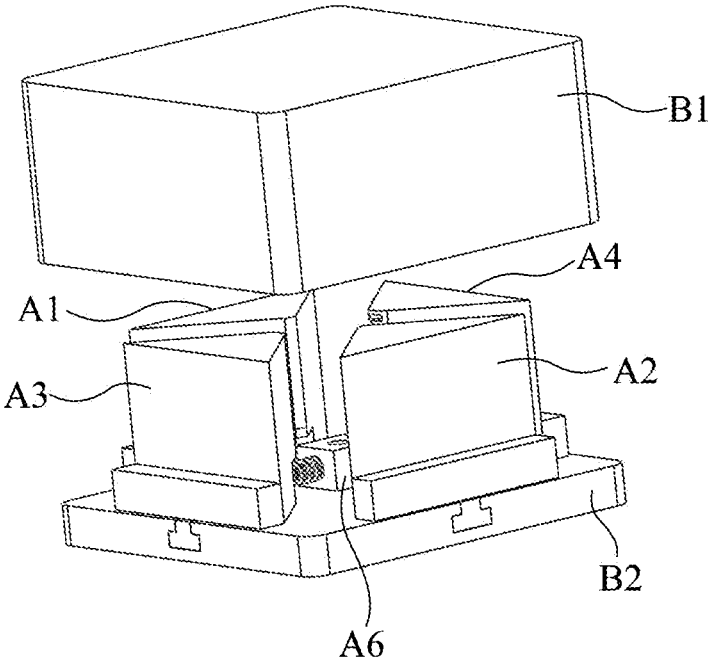
FIG. 9 to FIG. 10 are schematic views of a encapsulation mold for encapsulating the joint of the geocell.
Figure 10:
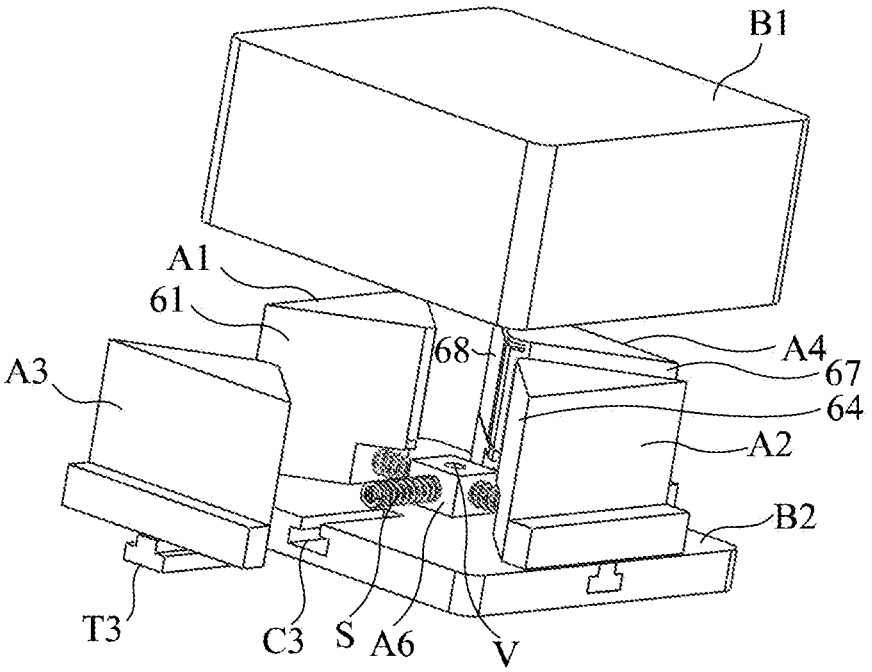

In Step 408, each joint is encapsulated. Step 408 includes the following: first, in step 409, the joint of the strips interconnected together by the U-shaped member is placed into an encapsulation mold. FIG. 9 and FIG. 10 show simplified schematic views of the encapsulation mold for encapsulating the joint of the strips. As shown in FIG. 9 and FIG. 10, the encapsulation mold mainly includes a first mold A1, a second mold A2, a third mold A3, a fourth mold A4, an upper base B1 and a lower base B2. Bottom surfaces of the first mold A1, the second mold A2, the third mold A3 and the fourth mold A4 are provided with T-shaped projections to cooperate with T-shaped grooves provided on the lower base B2, respectively, so that the first mold A1, the second mold A2, the third mold A3 and the fourth mold A4 can move relative to the lower base B2 to approach or to move away from each other, respectively. For example, a T-shaped projection T3 on the bottom surface of the third mold A3 cooperates with a T-shaped groove C3 on the lower base B2 to move along the T-shaped groove C3 to approach or to move away from a lower mold A6. The lower mold A6 is arranged at a middle position of the lower base B2. In the present exemplary embodiment, the lower mold A6 substantially is a cuboid. An elastic member such as a spring S is arranged on each side surface of the lower mold A6. A cavity V is further provided at a center of the lower mold A6. Similarly, an upper mold provided with a cavity in the center is arranged on the upper base B1.

In Step 409, the end portions of the U-shaped member 3 are first aligned with and the cavities of the upper mold and the lower mold, one end portion (for example, the end portions of the two upright portions of the U-shaped member 3, or an arched end portion of the U-shaped member 3) of the U-shaped member 3 is placed in the cavity V of the lower mold A6, and the cavity V forms a mold cavity of the end cover at the end portion of the U-shaped member 3. Then, one end of the first strip 111 is placed between the first mold A1 and the third mold A3, the other end of the first strip 111 is placed between the first mold A1 and the fourth mold A4, one end of the second strip 112 is placed between the second mold A2 and the third mold A3, and the other end of the second strip 112 is placed between the second mold A2 and the fourth mold A4. After the U-shaped member 3, the first strip 111 and the second strip 112 are placed as described above, the upper base B1 is moved downward, the first mold A1, the second mold A2, the third mold A3, the fourth mold A4 and the upper base B1 are integrally moved along the respective T-shaped grooves on the lower base B2 by a wedge-shaped structure (not shown) between the upper base B1 and the first A1 the second mold A2, the third mold A3 and the fourth mold A4 to approach each other, to abut against the first strip 111 and the second strip 112, and to compress the spring S on the respective side surface of the lower mold A6. During the downward movement of the upper base B1, the cavity (not shown) of the upper mold arranged on the upper base B1 moves toward the other end portion of the U-shaped member 3 (for example, the arched end portion of the U-shaped member 3, or the end portion of the two upright portions of the U-shaped member 3). After the upper base B1 is moved in position, the other end portion of the U-shaped member 3 is accommodated in the cavity of the upper mold on the upper base B1. The cavity of the upper mold forms the mold cavity of the end cover at the other end portion of the U-shaped member 3. Preferably, during this process, the first strip 111 and the second strip 112 may be in an appropriate pre-tensioned state, such that the molten colloid easily enters between the strips at the joint during the subsequent injection molding of the colloid, thereby enabling the two strips of the cell to be at the predetermined angle relative to each other, enabling the section of the column formed by the colloid, the strips and the portion of the U-shaped member located between the strips to be approximately square or circular, and enhancing the structural stability of the joint.

The first mold A1, the second mold A2, the third mold A3 and the fourth mold A4 are approximately trapezoidal, respectively. Top sides (short sides) of the trapezoids are opposite to each other, and the top sides (short sides) of the trapezoids are closer to the cavity V of the lower mold A6 than the bottom sides (long sides) of the trapezoids. Two oblique sides of the trapezoid may be at an angle of 90 degrees.

Figure 11:
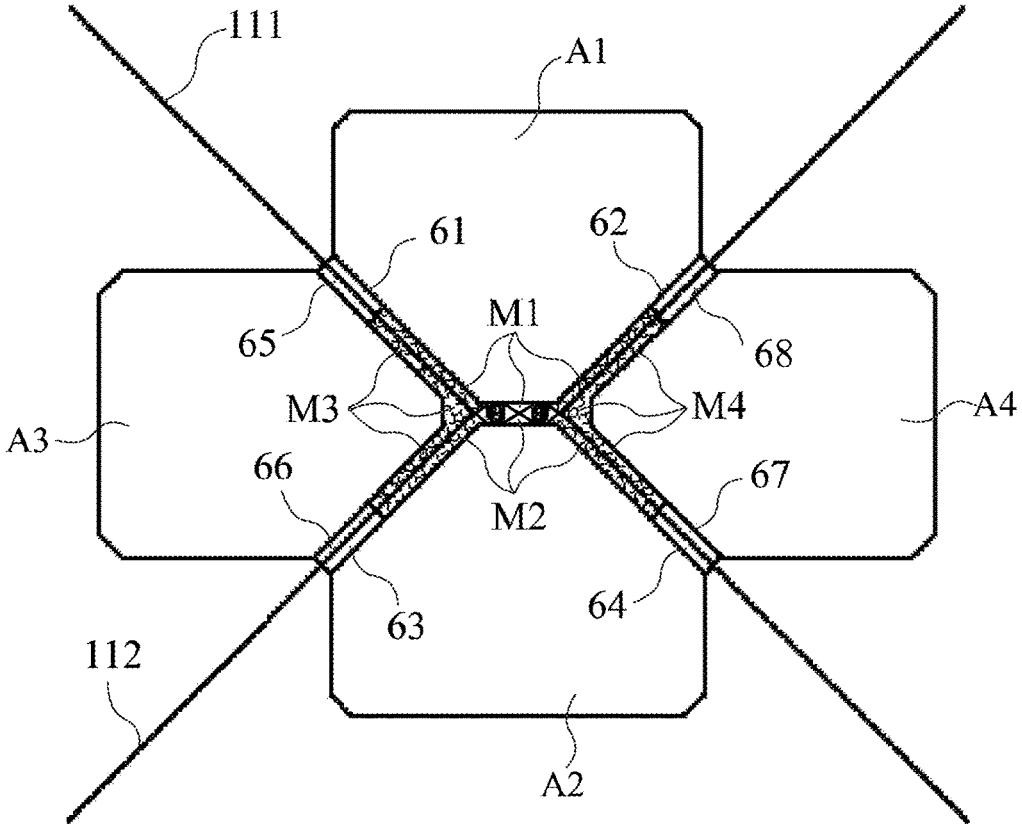
FIG. 11 is a schematic sectional view showing the encapsulation of the joint of the geocell.

FIG. 11 shows a schematic sectional view of the joint after the molds are moved in position. As shown in FIG. 9, the first mold A1 abuts against the first strip 111 from a side where the first strip 111 is located, and the second mold A2 abuts against the second strip 112 from a side where the second strip 112 is located. Top edges (short sides of the trapezoid) of the first mold A1 and the second mold A2 are opposed to the U-shaped member 3. Preferably, the length of the top side is greater than or equal to a distance between the two upright portions of the U-shaped member. The third mold A3 and the fourth mold A4 abuts against the first strip 111 and the second strip 112 from the left and the right sides between the first strip 111 and the second strip 112, respectively. In the shown embodiment, the top edges of the first mold A1 and the second mold A2 are opposite to the U-shaped member 3, while the top edges of the third mold A3 and the fourth mold A4 are opposite to the left and right sides of the U-shaped member 3. The length of the top edges of the first mold A1 and the second mold A2 is greater than the length of the top edges of the third mold A3 and the fourth mold A4. However, the present application is not limited thereto. In other feasible embodiments of the present application, the first mold A1, the second mold A2, the third mold A3 and the fourth mold A4 may have substantially identical shapes, and the top edges of the respective molds have the same length. Thus, when the strips are positioned in the encapsulation mold, the U-shaped member 3 may not be positioned right facing the first mold A1 and the second mold A2, but be positioned at a certain angle.

Outer end portions of the two oblique sides of the trapezoid of the first mold A1 may be formed with end walls 61, 62 protruding from the oblique sides. When the first mold A1 abuts against the first strip from the side where the first strip 11 is located, the protruding end walls 61, 62 respectively abut against the first strip 111, while other portions of the two oblique sides and the top side of the trapezoid of the first mold A1 are spaced apart from the first strip 11 and are not in contact with the first strip 111, thereby defining a mold cavity for injecting materials together with the first strip 111. Similarly, the outer end portions of the two oblique sides of the trapezoid of the second mold A2, the third mold A3 and the fourth mold A4 are also formed with end walls 63, 64, 65, 66, 67 and 68 protruding from the oblique sides, respectively. These end walls of the molds define the mold cavities for injecting materials together with the corresponding oblique portions, top sides, the first strip 111 and the second strip 112. Specifically, when the first mold A1 is pressed against the first strip 111 from the side where the first strip 11 is located, the end walls 61, 62 of the first mold A1 abut against the first strip 11*l*, such that portions of the two oblique sides of the first mold A1 that are not in contact with the first strip 111 and the top side of the first mold A1 define a cavity M1 together with the first strip 111, the end wall 61 and the end wall 62. When the second mold A2 is pressed against the second strip 112 from the side where the second strip 112 is located, the end walls 63, 64 of the second mold A2 abut against the second strip 112, such that portions of the two oblique sides of the second mold A2 that are not in contact with the second strip 112 and the top side of the second mold A2 define a cavity M2 together with the second strip 112, the end wall 63 and the end wall 64.

Similarly, when the third mold A3 and the fourth mold A4 are moved in position, the end wall 65 of the third mold A3 is opposite to the end wall 61 and the first strip 111 is sandwiched therebetween, the end wall 66 of the third mold A3 is opposite to the end wall 63 and the second strip 112 is sandwiched therebetween, the end wall 67 of the fourth mold A4 is opposite to the end wall 64 and the second strip 112 is sandwiched therebetween, the end wall 68 of the fourth mold A4 is opposite to the end wall 62 and the first strip 111 is sandwiched therebetween. Thus, portions of the two oblique sides of the third mold A3, that are not in contact with the first strip 111 and the second strip 112, and the top side of the third mold A3 define a cavity M3 together with the first strip 111, the second strip 112, the end wall 65 and the end wall 66; and portions of the two oblique sides of the fourth mold A4, that are not in contact with the first strip 111 and the second strip 112, and the top side of the fourth mold A4 define a cavity M4 together with the first strip 111, the second strip 112, the end wall 67 and the end wall 68.

After the first mold A1, the second mold A2, the third mold A3, the fourth mold A4 and the upper base B1 (the upper mold) are placed in position, the molten colloid is injected into the cavities (the cavity M1, the cavity M2, the cavity M3, the cavity M4, the cavity V of the lower mold A6 and the cavity of the upper mold) in Step 410. The sizes of the cavities match with the sizes of the colloid to be formed.

In the exemplary embodiments shown in FIG. 1 to FIG. 4, the thicknesses of the first strip 111 and the second strip 112 are both between 0.8 mm and 1 mm, the thickness of the colloid formed on each side surface of the first strip 111 and the second strip 112 at each joint is about 1 mm. Therefore, the thicknesses of the end walls 61, 62 of the first mold A1 may be about 1 mm. The structures and operations of the second mold A2, the third mold A3 and the fourth mold A4 are similar to those of the first mold A1. Further, the molten colloid injected into the cavity V of the lower mold A6 and the cavity of the upper mold completely covers the two ends of the U-shaped member 3, thereby forming two hemispherical end covers 51 and 52 as shown in FIG. 6. The sizes of the end covers 51, 52 may be set according to the required sizes of the cavities of the upper mold and the lower mold. Generally, the thicknesses of the colloid forming the end walls 51, 52 are significantly greater than the thicknesses of the colloid formed on the side surfaces of the first strip 111 and the second strip 112.

In the present exemplary embodiment, the cavity V of the lower mold A6 and the cavity of the upper mold are both hemispherical. However, it should be understood by those skilled in the art that the shape and size of the concave cavities of the lower mold and the upper mold can be set according to the requirements of the formed end covers 51, 52. For example, the end covers 51, 52 may also be formed in other shapes such as cuboid-shaped, cone-shaped or the like.

In the present exemplary embodiment, the strips are made of the PP material, and the molten TPE material is injected into each cavity to form the colloid 5. Since the PP material is well compatible with and the TPE material, the molten TPE material is bonded to the strip made of the PP material to form the colloid 5, which is not easily peeled off. An injection temperature of the colloid 5 is lower than the melting temperature of the strips to avoid damage to the strips when the molten material injected into each cavity comes into contact with the strips. The melting temperature of the PP material is generally 165 to 170 degrees Celsius, while the processing temperature of the TPE material is generally 150 to 200 degrees Celsius, which depends on the hardness of the TPE material. In an embodiment where the strips are made of the PP material and the colloid 5 is made of a soft TPE material, the melting temperature of the strips is above 150 degrees Celsius, and the injection temperature of the colloid 5 is about 130 degrees Celsius.

It should be noted that the injection temperature of the colloid 5 is set according to the material used. As described above, in addition to the soft TPE material, other soft materials may also be used to form the colloid 5.

After the molten TPE material injected into the cavities is bonded to the strips and the U-shaped member and is cooled, in Step 412, the strips are removed from the encapsulation mold, and the geocell according to the present application is obtained. Specifically, the upper base B1 is moved upward, and the first mold A1, the second mold A2, the third mold A3 and the fourth mold A4 are moved in the corresponding T-shaped grooves to move away from each other through the action of the springs S and the action of the wedge-shaped structure (not shown) located between the upper base B1 and the four molds, that is, the first mold A1, the second mold A2, the third mold A3 and the fourth mold A4, so that the sandwiched strips are loosen, and the strips with encapsulated joints are taken out of the encapsulation mold. The colloid 5 may be vulcanized before or after the mold is removed, according to different materials.

The above shows the method for manufacturing the geocell according to the present application and the geocell of the shown embodiment manufactured by the method, but the present application is not limited thereto.

In the above exemplary embodiments, the section of each cell of the geocell 100 perpendicular to the height direction is square, and two side edges of each of the first mold A1, the second mold A2, the third mold A3 and the fourth mold A4 are at an included angle of 90 degrees. The method for manufacturing the geocell according to the present application can also be applied to the manufacture of a geocell having cells of other shapes. For example, the section of each cell of the geocell perpendicular to the height direction may be rectangular, rhombus, other parallelogram, triangle or the like, and the included angle between the two side edges of the mold used can be modified accordingly.

FIG. 12 and FIG. 13 show other embodiments of the geocell. FIG. 12 shows a top view of a geocell 200 manufactured by the method for manufacturing the geocell according to the present application, and FIG. 13 shows a top view of a geocell 300 manufactured by the method for manufacturing the geocell according to the present application. The structures of the geocell 200 and the geocell 300 are substantially similar, and the only difference lies in that the included angle between the strips forming each cell of the geocell is different and the included angle between the two side edges of the mold used in the manufacturing process is accordingly different. The structures of the geocell 200 and the geocell 300 are substantially similar to the structure of the geocell 100. At each joint, the U-shaped member is inserted into the slits of the strips, and the colloid wrapping the joint is formed. The only difference lies in that the shape of the section of each cell perpendicular to the height direction is different, the number of the strips that are aligned and interconnected together at each joint by the U-shaped member is different, and in the process of manufacturing the geocell, the number of the molds used for encapsulating the joint is different, and the included angle between the two side edges of the mold is different.

In addition, in the above exemplary embodiments, the adjacent strips are interconnected together by the U-shaped member ate each joint, but the present application is not limited thereto, and the adjacent strips may also be interconnected together via an insert of other forms.

In the above exemplary embodiments, the connecting sheet for the U-shaped member is provided at the end portions of the two upright portions of the U-shaped member. However, the present application is not limited thereto. In the geocell according to the conception of the present application, the end portions of the two upright portions of the U-shaped member are both encapsulated to form the end covers at each point, the end covers can prevent the two upright portions of the U-shaped member from falling off the strips. Therefore, in the other feasible embodiments of the present application, the connecting sheet for the U-shaped member may not be provided.

So far, the exemplary embodiments of the present application have been described in detail, but it should be understood that the present application is not limited to the specific embodiments described and illustrated above. Various modifications and variations can be made to the present application by those skilled in the art without departing from the spirit and scope of the present application. All such modifications and variations are intended to fall within the scope of the present application. Moreover, all of the components described herein can be replaced by other technically equivalent components.

The invention claimed is:

1. A geocell, comprising a plurality of strips, the plurality of strips being connected with each other at a plurality of joints to form a plurality of cells, wherein:

at each of the joints, two or more adjacent strips of the plurality of the strips are interconnected with each other via an insert;

each of the joints is covered by a colloid;

at each of the joints, two or more adjacent strips of the plurality of the strips are aligned, and are provided with slits penetrating the two or more adjacent strips, the slits extend along a longitudinal direction of the two or more adjacent strips, and the insert sequentially and alternately passes through the slits to interconnect the two or more adjacent strips together; and the colloid covers each side surface of the two or more adjacent strips to completely cover the slits, and covers at least part of the insert;

wherein at each of the joints the two or more adjacent strips have a same height direction, and each of the joints is covered by the colloid through injection molding to make each of the joints be in a preset state in which an included angle between each two adjacent strips of the two or more adjacent strips is 90 degrees.

2. The geocell according to claim 1, wherein the slits are distributed at equal intervals along the height direction of the two or more adjacent strips.

3. The geocell according to claim 1, wherein the insert at each of the joints is completely covered by the colloid.

4. The geocell according to claim 3, wherein at each of the joints, the insert is bonded with the two or more adjacent strips and the colloid to form a whole, and end portions of the insert are completely covered by the colloid to form end covers.

5. The geocell according to claim 1, wherein the colloid is molded at the joints with an injection temperature lower than a melting temperature of the strips.

6. The geocell according to claim 1, wherein the strips are made of a PP material or a PET material; and/or, the colloid is made of one or more of TPE, TPR, TPU, SBS, EVA, silica gel, PVC, PP, PE, HDPE, TPEE, EBA, EEA, and EMA.

7. The geocell according to claim 1, wherein the insert is a U-shaped member having two upright portions, and wherein the two upright portions of the U-shaped member sequentially and alternately pass through the slits; and/or, a connecting sheet for the U-shaped member is provided at end portions of the two upright portions of the U-shaped member.

8. The geocell according to claim 1, wherein a thickness of the colloid on each side surface of the two or more adjacent strips is greater than or equal to a thickness of the corresponding strip of the two or more adjacent strips.

9. A method for manufacturing a geocell, the method comprising providing a plurality of strips;

aligning two or more adjacent strips of the plurality of strips at joints and forming slits penetrating the two or more adjacent strips;

sequentially and alternately passing an insert through the slits at each of the joints to interconnect the two or more adjacent strips together; and encapsulating the joints to form a colloid, wherein the colloid covers each side surface of the two or more adjacent strips to completely cover the slits, and covers at least part of the insert;

wherein at each of the joints the two or more adjacent strips have a same height direction; and wherein the step of encapsulating is achieved by injection molding, wherein the before performing the step of encapsulating or during the step of encapsulating, the two or more adjacent strips are stretched to allow each of the joints to be in a preset state in which an included angle between each two adjacent strips of the two or more adjacent strips is 90 degrees.

10. The method for manufacturing the geocell according to claim 9, wherein the slits are distributed at equal intervals along the height direction of the two or more adjacent strips.

11. The method for manufacturing the geocell according to claim 9, wherein the insert at each of the joints is completely covered by the colloid.

12. The method for manufacturing the geocell according to claim 11, wherein at each of the joints, the insert is bonded with the two or more adjacent strips and the colloid to form a whole, and end portions of the insert are completely covered by the colloid to form end covers.

13. The method for manufacturing the geocell according to claim 9, wherein the colloid goes through vulcanization after the step of encapsulating or during the step of encapsulating.

14. The method for manufacturing the geocell according to claim 9, wherein the colloid is molded at the joints with an injection temperature lower than a melting temperature of the strips.

15. The method for manufacturing the geocell according to claim 9, wherein the insert is a U-shaped member having two upright portions, and wherein the two upright portions of the U-shaped member sequentially and alternately pass through the slits; and/or, a connecting sheet for the U-shaped member is provided at end portions of the two upright portions of the U-shaped member.

16. The method for manufacturing the geocell according to claim 9, wherein a thickness of the colloid on each side surface of the two or more adjacent strips is greater than or equal to a thickness of the corresponding strip of the two or more adjacent strips.

* * * * *